US006962208B2

(12) United States Patent
Franson et al.

(10) Patent No.: US 6,962,208 B2
(45) Date of Patent: Nov. 8, 2005

(54) COMPACT PENDANT SPRINKLER HEAD

(75) Inventors: Scott Thomas Franson, Hastings, MI (US); Kenneth Gordon Vos, Lowell, MI (US); Thomas Edgar Winebrenner, Hastings, MI (US); Andrew Taylor Thompson, Kentwood, MI (US)

(73) Assignee: The Viking Corporation, Hastings, MI (US)

( * ) Notice: Subject to any disclaimer, the term of this patent is extended or adjusted under 35 U.S.C. 154(b) by 259 days.

(21) Appl. No.: 09/854,997

(22) Filed: May 14, 2001

(65) Prior Publication Data

US 2001/0042795 A1 Nov. 22, 2001

Related U.S. Application Data

(60) Provisional application No. 60/204,858, filed on May 17, 2000.

(51) Int. Cl.[7] ..... A62C 37/08

(52) U.S. Cl. ..... 169/37; 169/38; 169/39; 169/40; 169/41; 169/16; 169/19

(58) Field of Search ..... 169/37–42, 16, 169/19; 239/498, 480, 476, 482, 483, 496, 497, 500, 505, 514

(56) References Cited

U.S. PATENT DOCUMENTS

| | | | | |
|---|---|---|---|---|
| 2,076,483 | A | 4/1937 | Rowley | 169/37 |
| 2,135,138 | A | 11/1938 | Kendall | 299/18 |
| 2,155,990 | A | 4/1939 | Hodgman, Jr. | 169/39 |
| 2,211,399 | A | 8/1940 | Winslow | 169/39 |
| 2,697,008 | A | 12/1954 | Rowley | 299/121 |
| 3,195,647 | A | 7/1965 | Campbell et al. | 169/1 |
| 3,459,266 | A | 8/1969 | Ault | 169/37 |
| 4,014,388 | A | 3/1977 | Anderson | 169/37 |
| 4,015,665 | A | 4/1977 | Simons et al. | 169/40 |
| 4,105,076 | A | 8/1978 | Simons et al. | 169/40 |
| 4,217,960 | A | 8/1980 | Miyazaki | 169/38 |
| 4,491,182 | A | 1/1985 | Pieczykolan | 169/38 |
| 4,508,175 | A | 4/1985 | Pieczykolan | 169/38 |
| 4,596,289 | A | 6/1986 | Johnson | 169/37 |
| 4,616,710 | A | 10/1986 | Pilant et al. | 169/41 |
| 4,618,001 | A | 10/1986 | Hoening | 169/23 |
| 4,618,002 | A | 10/1986 | Mears | 169/37 |
| 4,660,648 | A | 4/1987 | Zen | 169/38 |
| 4,715,447 | A | 12/1987 | Johnson | 169/37 |
| 4,766,961 | A | 8/1988 | Macie | 169/38 |
| 4,785,888 | A | 11/1988 | Blum et al. | 169/39 |
| 4,880,063 | A | 11/1989 | Leininger et al. | 169/37 |
| 4,926,946 | A | 5/1990 | Polan | 169/37 |
| 4,938,292 | A | 7/1990 | Johnson | 169/19 |
| 4,976,320 | A | 12/1990 | Polan | 169/39 |
| 4,977,963 | A | 12/1990 | Simons | 169/37 |
| 5,036,923 | A | 8/1991 | Shea, Sr. | 169/37 |
| 5,083,616 | A | 1/1992 | Polan | 169/40 |
| 5,094,298 | A | 3/1992 | Polan | 169/41 |
| 5,152,344 | A | 10/1992 | Fischer et al. | 169/37 |
| 5,234,059 | A | 8/1993 | Eynon | 169/39 |
| 5,299,645 | A | 4/1994 | Hoening et al. | 169/39 |
| 5,372,203 | A | 12/1994 | Galaszewski | 169/37 |
| 5,415,239 | A | 5/1995 | Kötter et al. | 169/41 |
| 5,613,563 | A | 3/1997 | Johnson | 169/39 |
| 5,664,630 | A | 9/1997 | Meyer et al. | 169/37 |
| 5,687,914 | A | 11/1997 | Bosio et al. | 239/498 |
| 5,775,431 | A | 7/1998 | Ondracek | 169/37 |
| 5,839,667 | A | 11/1998 | Fishcer | 293/498 |

*Primary Examiner*—Davis Hwu
(74) *Attorney, Agent, or Firm*—Van Dyke, Gardner, Linn & Burkhart, LLP

(57) ABSTRACT

A pendant sprinkler head includes a sprinkler body formed with a central orifice, and a sealing member positioned within the orifice and in sealing engagement with the inlet. A deflector assembly is at least partially positioned within the orifice and includes an annular ring having a pair of attachment arms secured to a deflector plate positioned in proximity to, or partially within the outlet. A retaining ring positioned within the orifice acts as a stop, preventing the annular ring from being expelled from the orifice. According to another aspect of the invention, a pendent sprinkler head includes a sprinkler body and a body extension connected to the body. A deflector plate is formed with a plurality of support members received by a retaining ring positioned in proximity to the bottom of the sprinkler body, and within the body extension. The body extension is configured to capture the retaining ring upon activation, enabling the deflector plate to depend below the body extension.

36 Claims, 10 Drawing Sheets

COMPACT PENDANT SPRINKLER HEAD

CROSS REFERENCE TO RELATED APPLICATION

This Application claims priority in the U.S. Provisional Patent Application Ser. No. 60/204,858, filed May 17, 2000, the entire disclosure of which is hereby incorporated herein by reference.

BACKGROUND OF THE INVENTION

The present invention relates to sprinklers used in automatic fire extinguishing systems for buildings and the like, and in particular, to a compact pendant sprinkler head assembly.

Sprinkler heads have long been used in automatic fire extinguishing systems for buildings and the like in order to disburse a fluid to suppress or extinguish a fire. Typically, the fluid utilized in such systems is water, although systems have been developed to disburse foam and other materials. Historically, sprinkler heads include a solid metal base connected to a pressurized water source, and a deflector intended to alter the trajectory of the water and distribute the water spray pattern over a controlled area. The deflector is typically spaced from the base outlet, and a fusible trigger assembly secures a seal over the base outlet. When the temperature about the sprinkler head is elevated to a preselected temperature indicative of a fire, the fusible trigger assembly releases the seal, and water flow is initiated through the sprinkler head. The water ejected from the sprinkler head impacts the deflector, resulting in a preselected water distribution pattern which descends upon the fire.

One common sprinkler head design is a pendant sprinkler head, whereby the sprinkler head is positioned in a downward direction towards the floor of the controlled area. With such pendant sprinkler heads, normally, the deflector is positioned a preselected distance below the outlet of the sprinkler body, and is secured to a pair of arms extending away from outlet of the sprinkler body. In response to the activation of the fusible trigger assembly, the sealing assembly falls away from the sprinkler body, allowing water to be transported through the sprinkler body in a downward direction towards the deflector.

The deflector in many current pendant sprinkler head designs is positioned a fixed distance from the outlet of the sprinkler body, and thereby increases the size of the sprinkler head. Furthermore, in many applications, aesthetic considerations demand that the sprinkler body is compact and relatively unnoticeable. In addition, many applications require an effective, compact sprinkler head in order to maximize space utilization. Current pendant sprinkler heads are generally incapable of being used under such conditions, as the size and particular structural configuration yields a sprinkler head which is conspicuously noticeable, as well as relatively large.

In response, the industry has advanced pendant sprinkler heads which are designed to be recessed within a ceiling or other wall. These recessed pendant sprinklers often include a deflector positioned between the fusible trigger assembly and the outlet of the sprinkler. Upon separation of the fusible trigger assembly, the water pressure travelling through the orifice of the sprinkler head moves the deflector a preselected distance away from the outlet. The deflector is normally attached to two or more vertically extending rods or pins slidably received by apertures formed in a flange or rim projecting from the exterior surface of the sprinkler head.

The free end of each pin is formed with an increased diameter, and thus, as the water pressure forces the deflector away from the outlet, the pin ends abuttingly contact the flange or rim to hold the deflector in place.

The use of pins to enable the deflector to move a preselected distance from the outlet upon activation of the sprinkler head, and the flanges or rim into which they are slidingly positioned have certain disadvantages. The pins, as they are external to the sprinkler body can gather dust, particulate matter, or fluids residing within the wall or ceiling into which the pendent sprinkler head is attached. This dirt and debris may collect within the apertures formed within the flange or rim and prevent the efficient and smooth movement of the pins through the aperture in response to a fire, and in consequence, prevent the proper operation of the sprinkler head. In addition, the pin receiving flanges or rim projecting from the sprinkler body necessarily requires the cavity of the wall or ceiling into which the sprinkler is placed to be larger in diameter. That is, to enable clearance of the rim or flange, the hole through which the pendent sprinkler head is inserted must be larger. This in turn prevents such pendent sprinkler heads from being used in environments wherein efficient use of space is required.

Accordingly, there exists a need for a high volume pendant sprinkler head which is compact to thereby enable use in applications wherein effective space utilization must be observed.

SUMMARY OF THE INVENTION

In one embodiment, the present invention overcomes the difficulties confronted by the prior art by providing a compact sprinkler head having a deflector assembly positioned within a body extension of the sprinkler head. According to one preferred aspect of the present invention, the sprinkler head includes a slidable deflector carried by at least one support arm a fixed distance from a retaining ring, with the deflector, at least one support arm, and retaining ring slidable within the body extension. Preferably, the sprinkler head includes a sprinkler body having an orifice, an inlet, and an outlet, with the body extension attached to the sprinkler body and having an extending section extending below the outlet. The retaining member is positioned between the bottom of the sprinkler head and within the body extension, while the deflector is positioned within the body extension with the at least one support arm attached to the retaining member. The retaining member is movable relative to both the sprinkler body and the body extension, while the at least one support arm maintains the deflector a fixed distance from the retaining member. A sealing assembly sealingly engages the outlet of the sprinkler body and is movable from a closed position wherein the sprinkler head is inactive to an open position wherein the sprinkler head is activated. A trigger assembly is carried by the body extension and operably connected with the sealing member. Configuring a sprinkler head to have a deflector movably positioned within a frame results in a compact sprinkler head which may be used in applications where space constraints must be observed, and eliminates the need for support pins attached to the deflector and residing external to the sprinkler body.

According to another preferred aspect of the invention, the deflector is monolithically formed with its support arms and the sprinkler head includes a sprinkler body, a body extension attached to the sprinkler body, a retaining member slidably positioned beyond the bottom surface of the sprinkler body and within the body extension, and a deflector. The deflector is positioned below the retaining member and is attached to the retaining member by the at least two support members projecting from the deflector towards the retaining member. A sealing assembly is configured to sealingly engage the outlet of the sprinkler body while a trigger assembly is carried by the body extension and operably connected with the sealing assembly. Providing a deflector positioned within the body extension reduces the diameter of the sprinkler head, while monolithically forming the deflector and the support members decrease its manufacturing cost.

According to yet another preferred aspect of the invention, a body extension is formed with an extending section having an annular rim while an annular retaining member, attached to a deflector, is slidably positioned within the body extension and captured by the annular rim. The sprinkler head includes a sprinkler body, and the body extension attached to the sprinkler body. The annular retaining member is positioned beyond the bottom of the sprinkler body, within the body extension, and has an outer periphery formed with at least one notch and a diameter greater than the diameter of the inwardly extending annular rim. The deflector is positioned within the body extension and has at least one support arm projecting therefrom. The support arm has an upper region dimensioned for receipt by the notch formed in the annular retaining member. A sealing assembly is configured to sealingly engage the outlet of the sprinkler body while a trigger assembly is carried by the body extension and operably connected with the sealing assembly. Providing an annular retaining member formed with notches for attachment to the deflector provides an effective and reliable structure without the use of externally mounted deflector pins. Additionally, the annular retaining member which is captured by the annular rim provides a reliable structure for moving the deflector to a preselected position upon activation of the sprinkler head.

In another preferred aspect of the invention, a sprinkler head includes a sprinkler body having an cavity, wherein the cavity has an inlet orifice, an outlet, and a trigger assembly carried by the sprinkler body. A sealing member is positioned within the cavity, while a slidable deflector support assembly is at least partially positioned within the cavity. The slidable deflector support assembly includes an annular ring and at least one attachment arm depending from the annular ring and attached to a deflector. A sealing assembly, carried by the sprinkler body is configured to urge the sealing member into engagement with the seat to thereby provide a fluid tight seal for the sprinkler body. Configuring a sprinkler head to have a sealing member positioned in fluid tight arrangement with the seat, and a deflector support assembly at least partially positioned within the cavity results in a compact sprinkler head which may be used in applications wherein space constraints must be observed.

In yet another preferred aspect of the invention, a sprinkler head includes a movable compression member that slides through a movable deflector. The sprinkler head preferably includes a body and a sealing member that closes the sprinkler orifice, with the compression member holding the sealing member in a closed condition. A trigger assembly holds the deflector and compression member in the closed position, and when activated permits the deflector to move away from the sprinkler body and the compression member to slide through the deflector. Placing the deflector and the compression member within the central cavity of the sprinkler body reduces the dimensions of the sprinkler head and thereby enables its use in applications requiring a compact sprinkler.

These and other advantages, benefits and objects will be understood by one with ordinary skill in the art from the drawings, description and claims which follow.

DETAILED DESCRIPTION OF THE PREFERRED EMBODIMENTS

Figure 1:
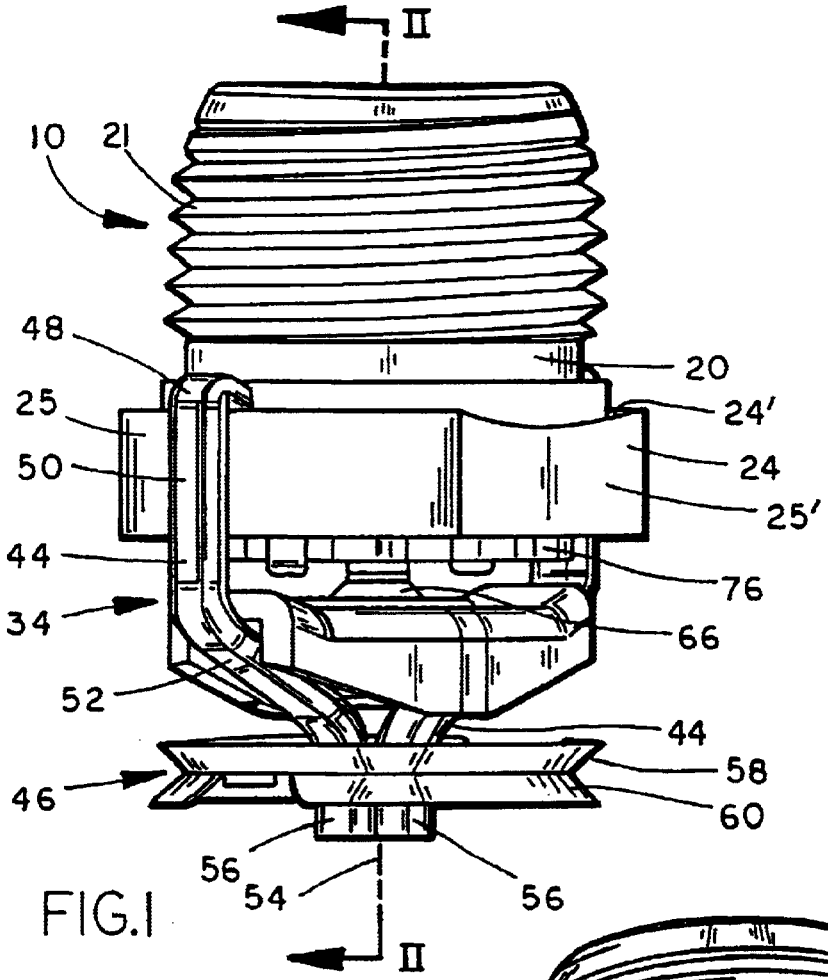
FIG. 1 is a perspective view of the pendant sprinkler head embodying the present invention.

The present invention is embodied in a pendant sprinkler head, referred to generally by reference numeral 10. The present invention provides a sprinkler head which by its structure is compact and reliable. Furthermore, given the decreased size and compact nature of the present invention, it is particularly suited for applications wherein it is desired to have a sprinkler head which may be recessed in a ceiling and/or have a reduced visibility to thereby maintain the aesthetic appearance of the environment in which it is used, for example, in residential applications.

Figure 16:
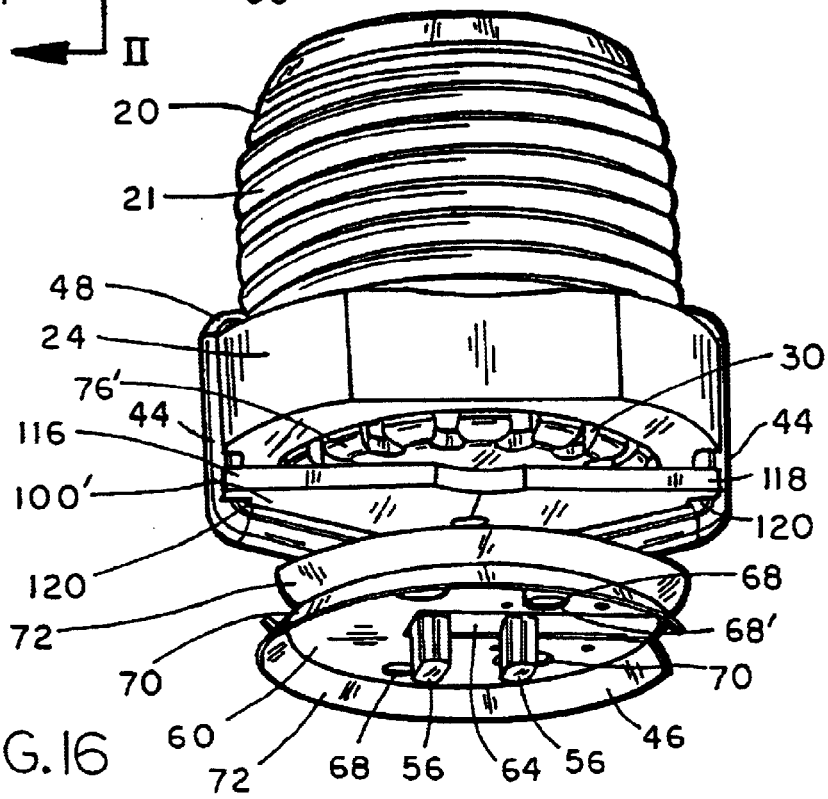
FIG. 16 is a perspective view of a sprinkler head according to an alternative preferred embodiment of the present invention.
Figure 3:
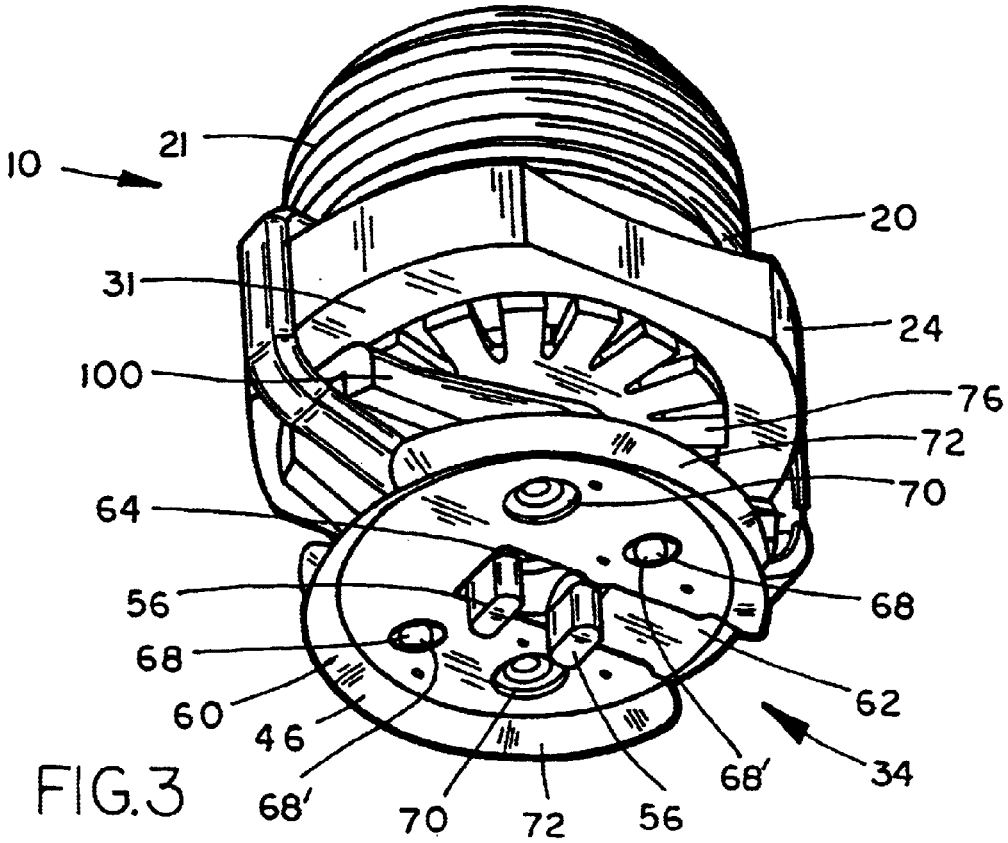
FIG. 3 is a bottom perspective view of the sprinkler head depicted in FIGS. 1 and 2.
Figure 2:
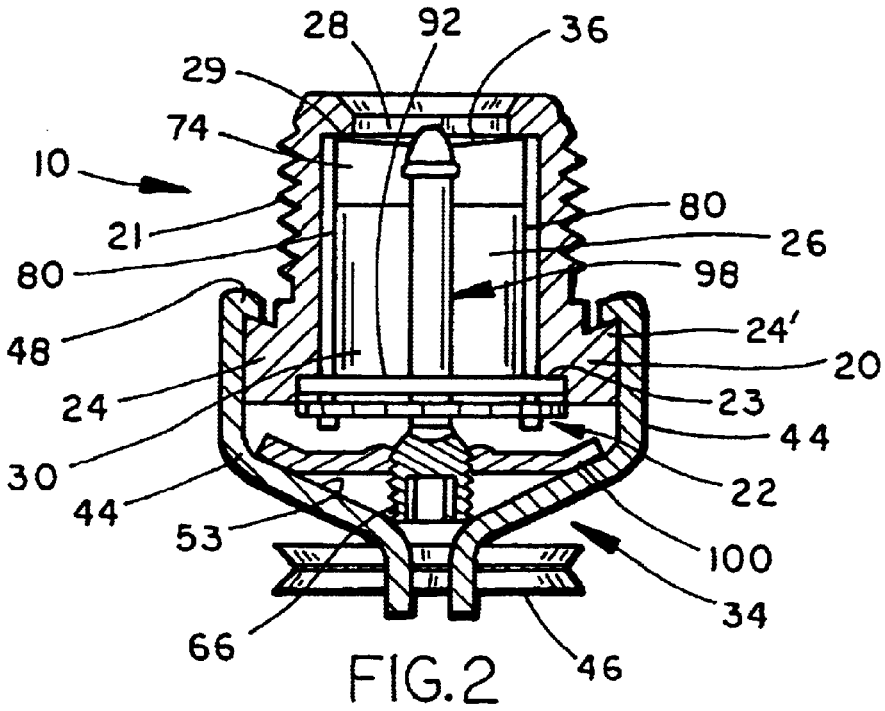
FIG. 2 is a cross sectional view of the sprinkler head depicted in FIG. 1, taken along the line II—II of FIG. 1.
Figure 17:
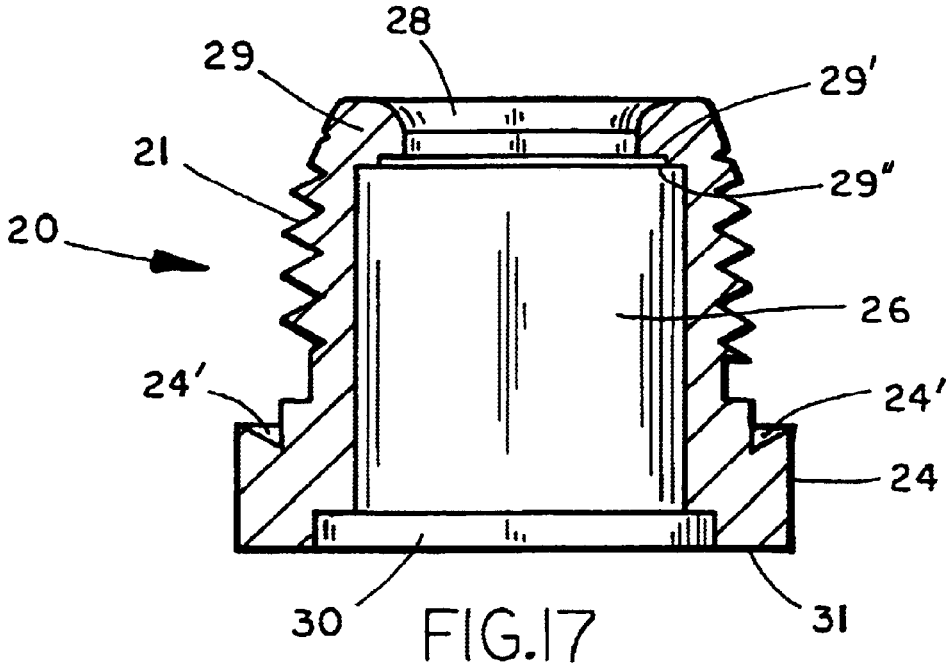
FIG. 17 is a sectional view of a sprinkler body of a preferred embodiment of the present invention.
Figure 18:
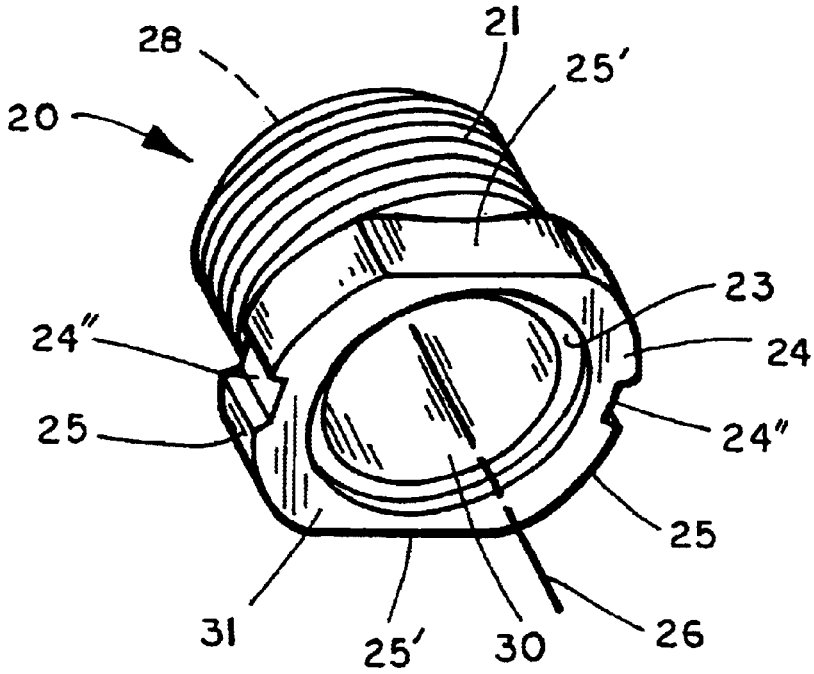
FIG. 18 is a bottom perspective view of a sprinkler body according to an alternative preferred embodiment of the present invention.

Referring now to FIGS. 1 through 18, sprinkler head 10 includes a sprinkler body 20 having an upper region 21 which is preferably externally threaded so as to allow removable attachment of sprinkler body 20 to a piping system (not shown). Positioned below upper region 21 is a flange or rim 24. Preferably, as shown in FIG. 18, rim 24 has a pair of opposed arcuate sections 25, and a pair of opposed linear sections 25'. Sprinkler body 20 is formed having a cavity 26 with an inlet orifice 28 (FIGS. 2 and 17) and opposing outlet 30. Outlet 30 has a larger diameter than cavity 26, and hence defines an annular shoulder 23, while inlet orifice 28 includes an annular shoulder or seat 29 projecting within cavity 26 (FIGS. 2 and 17). Annular shoulder or seat 29 further includes an annular groove 29' (FIG. 17).

Positioned substantially within cavity 26 of sprinkler body 20 is a deflector assembly 22. A trigger assembly 34 engages exterior 24' of sprinkler body 20 and extends below, but in close proximity to, outlet 30 of sprinkler body 20. A sealing member 36 is placed in fluid tight engagement with seat 29 of sprinkler body 20.

Figure 4:
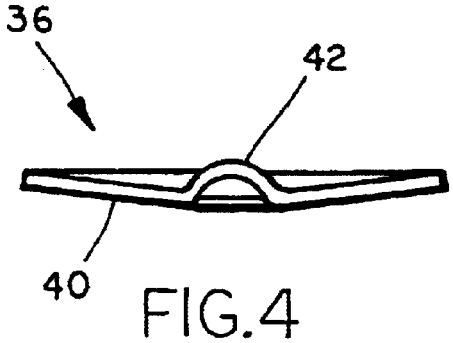
FIG. 4 is a cross sectional view of a sealing member embodying the present invention.

Sealing member 36, as shown most clearly in FIGS. 2 and 4, is preferably a spring disk having an internal bias in a direction towards outlet 30 of sprinkler body 20. The spring force of sealing member 36 assures that upon activation of sprinkler body 20, sealing member 36 will spring in a direction towards outlet 30, to thereby urge a sealing assembly 98 from central cavity 26. Under surface 40 of sealing member 36 is preferably formed having an arcuate dome or protuberance 42, the purpose of which will be described in detail below.

Trigger assembly 34 includes a pair of lever arms 44 and a fusible link 46. Lever arms 44 include an upper curved attachment section 48 integrally attached to a generally vertical member 50. Vertical member 50 is joined to an inwardly curved section 52, curved generally towards the vertical axis of sprinkler body 20, as indicated by dotted line 54 of FIG. 1. Inwardly curved section 52 is joined to a generally vertical fusible link attachment end 56. Received within ends 56 of lever arms 44 is a fusible link 46. Preferably, fusible link 46 includes a pair of plates 58 and 60 joined by a layer of fusible material. As shown most clearly in FIG. 3, each plate 58, 60 is formed with a radial channel 62 which is greater in length than the radius of plate 58, 60 so that when plates 58 and 60 are in the assembled condition, a central aperture 64 is formed for receipt of ends 56 of lever arms 44. Ends 56 of lever arms 44 are placed in spaced relation within center aperture 64 such that a loading member 66, and its adjustment tool (not shown), may be placed therethrough.

Each plate 58, 60, may further be formed with one or more protuberances 68 and one or more indentations 70. Protuberances 68 and indentations 70 are formed in plates 58, 60 such that when assembled, protuberances 68 of one plate 58, 60 are in registry with indentations 70 of the other plate 58, 60. Each protuberance 68 is formed with an aperture 68'. The presence of protuberances 68 and indentations 70 promote the timely separation of plates 58, 60 upon experiencing a preselected elevated temperature. Each plate 58, 60 may be further formed with a peripheral flange 72 such that when assembled, flange 72 of plate 58 extends in a direction opposite to the direction of flange 72 of plate 60.

Figure 6:
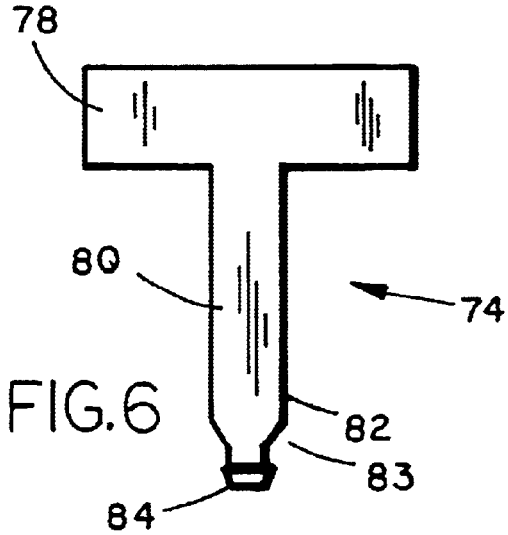
FIG. 6 is a side view of the deflector support assembly depicted in FIG. 5.

Deflector assembly 22 includes a deflector support assembly 74 attached to a deflector plate 76. Deflector support assembly 74 includes an annular cage or ring 78 dimensioned to be slidingly received within cavity 26. Annular ring 78 has depending therefrom at least one, and preferably two or more, deflector attachment arms 80 secured at end 82 to deflector plate 76. As shown in FIG. 6, end 82 of each deflector attachment arm 80 has a tapered section 83 and terminates in a bulb 84. Tapered section 83 permits each deflector attachment arm 80 to be received by an attachment aperture 86 formed in deflector plate 76, while bulb 84 prevents detachment of deflector plate 76 from deflector attachment arms 80 once secured thereto.

Figure 10:
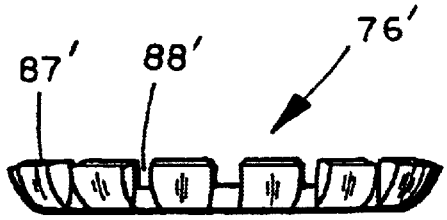
FIG. 10 is a side view of the deflector plate depicted in FIG. 9.
Figure 9:
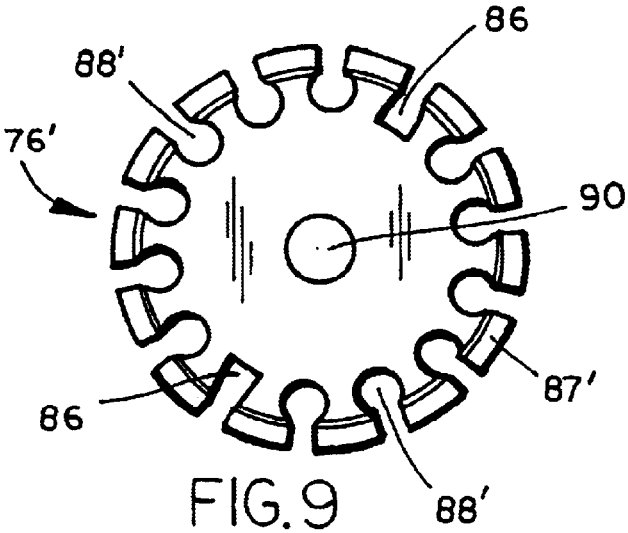
FIG. 9 is a top view of a deflector plate according to an alternative preferred embodiment of the invention.
Figure 12:
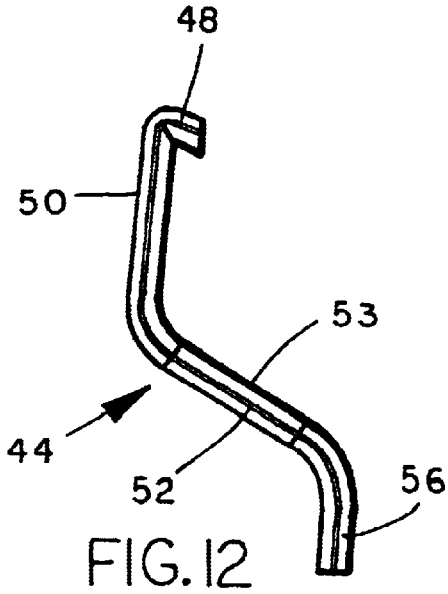
FIG. 12 is a side view of a lever arm of a preferred embodiment of the present invention.
Figure 11:
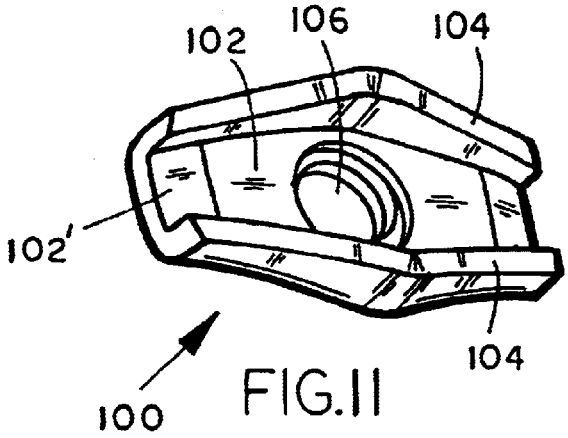
FIG. 11 is a bottom perspective view of a lever bar of a preferred embodiment of the present invention.
Figure 13:
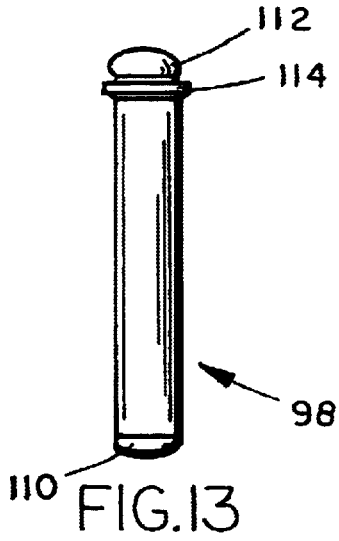
FIG. 13 is a perspective view of a compression pin of a preferred embodiment the present invention.
Figure 14:
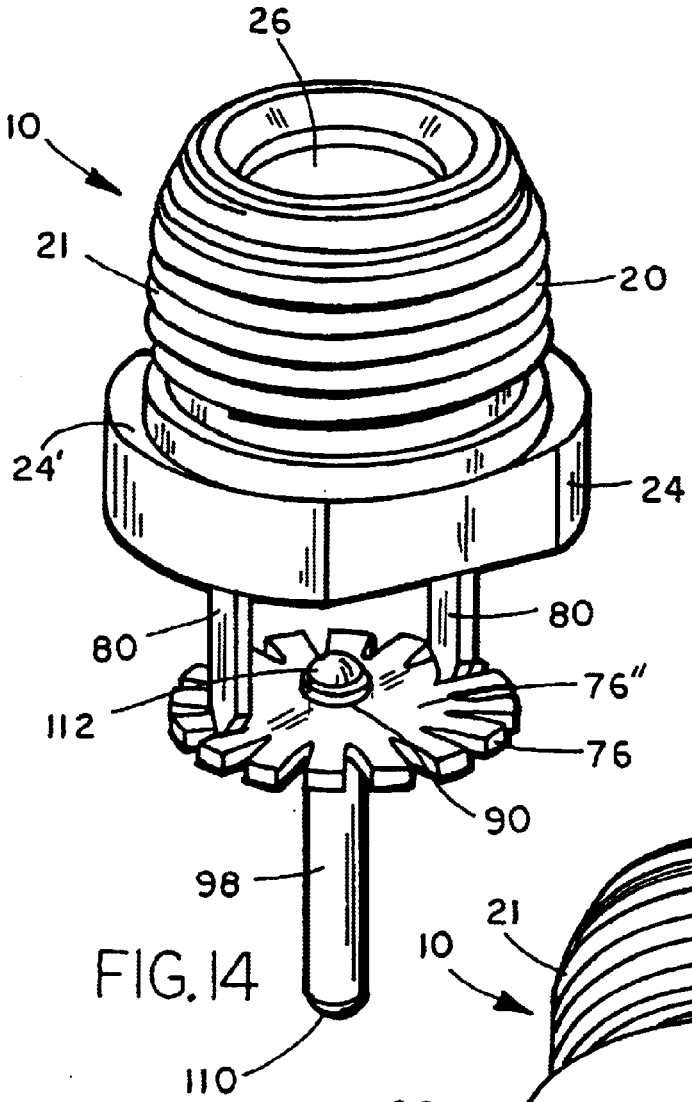
FIG. 14 is a perspective view of the sprinkler head depicted in FIGS. 1 and 2, illustrated in the activated position.

Deflector plate 76 includes a plurality of slots 88 extending inwardly from periphery 87. Preferably, slots 88 extend inwardly in a radial pattern and are wedge shaped. A central aperture 90 is formed in deflector plate 76. In an alternative preferred embodiment, as shown at FIGS. 9, 10, and 16, a deflector 76' includes a periphery 87' which is curved in a direction toward inlet orifice 28 of sprinkler body 20. Furthermore, deflector 76' contains a plurality of generally keyhole shaped slots 88' positioned in space relation about the periphery 87', and extending inwardly in a radial pattern. The curved periphery 87', along with keyhole shaped slots 88' are believed to result in an optimum water distribution pattern to thereby effectively control a fire. Annular ring 78, deflector attachment arms 80, and deflector plate 76 may be monolithic.

Figure 7:
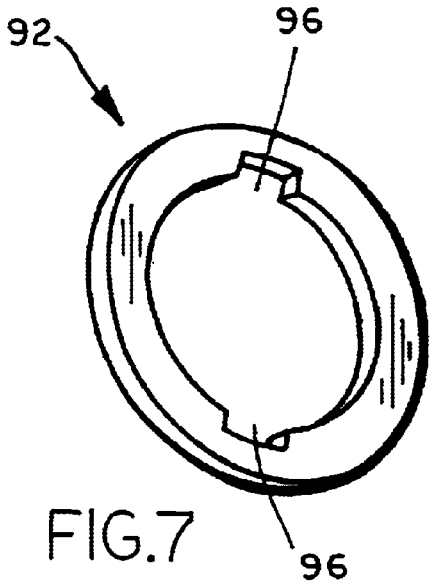
FIG. 7 is a perspective view of a retaining ring embodying to the present invention.
Figure 15:
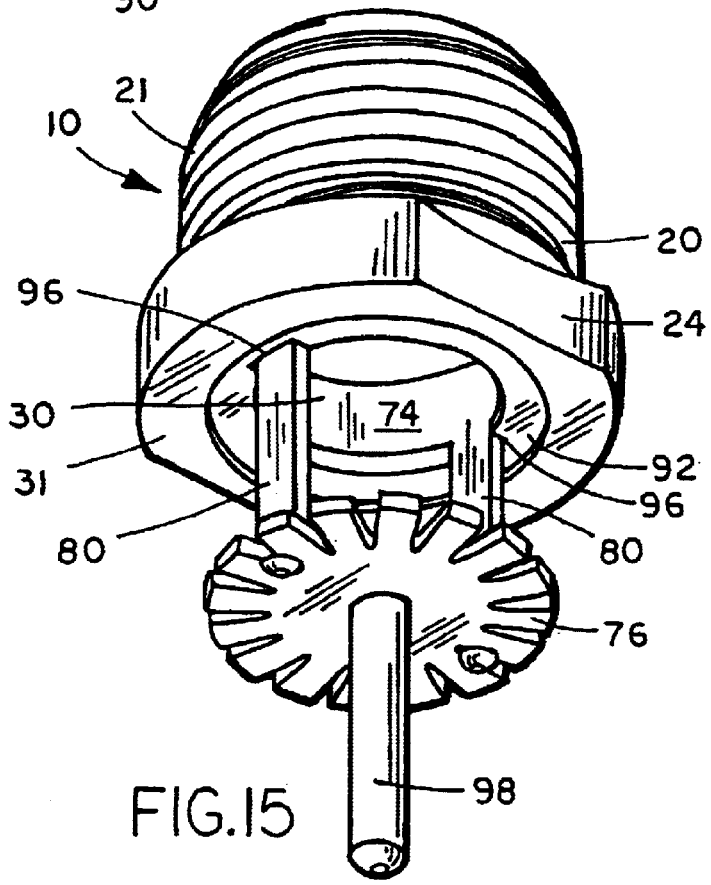
FIG. 15 is a bottom perspective view of the sprinkler head depicted in FIG. 14.

When in assembled condition, deflector 76 or 76', is positioned in close proximity to outlet 30. Preferably, at least a portion of deflector 76, 76' resides within outlet 30. In addition, annular ring 78 will be positioned adjacent to sealing member 36 and against annular shoulder 29", all within cavity 26. As shown in FIGS. 2, 7, and 15, positioned within central cavity 26, and proximate to outlet 30, is a retaining ring 92. Retaining ring 92 is held at outlet 30 and is positioned against shoulder 23. Retaining ring 92 is secured at outlet 30, for example, by crimping exterior surface 31 of outlet 30 about retaining ring 92. As shown in FIG. 7, retaining ring 92 includes an inner surface 94 formed having a pair of slots 96. Slots 96 are dimensioned to slidingly receive deflector attachment arms 80 therein. Inner surface 94 of retaining ring 92 has a diameter which is less than the outer diameter of annular ring 78. This smaller diameter of inner surface 94 of retaining ring 92 enables retaining ring 92 to act as a stop to thereby prevent the expulsion of deflector 76 beyond a preselected distance from outlet 30 upon activation.

The sealing assembly includes sealing member 36, a compression pin 98, and a lever bar 100. Lever bar 100 is composed of a bridge member 102, having ends 102' slanted towards outlet 30 of sprinkler head 20, and a pair of generally orthogonally projecting side members 104. Side members 104 are placed in space relation such that when in the assembled condition, ends 102' of bridge member 102 rest on inner surface 53 of inwardly curved section 52 of lever arms 44. Lever bar 100 includes a central aperture 106 which is internally threaded and dimensioned to threadingly receive loading member 66, which is preferably a loading screw.

Compression pin 98 is a generally vertical member having opposing ends 110 and 112. Compression pin 98 is slidingly received by a central aperture 90 formed in deflector 76 or 76'. End 112 of compression pin 98 includes an annular rim 114. Annular rim 114 has a diameter greater than the diameter of central aperture 90 of deflector 76 or 76', and thereby prevents compression pin 98 from being separated from deflector 76 or 76'.

To assemble sprinkler head 10, sealing member 36 is first placed in abutting contact with seat 29, formed in inlet orifice 28. Deflector support assembly 74 is then placed within cavity 26, with annular ring 78 contacting surface 29". Thereafter, retaining ring 92 is placed in contact with shoulder 23, and exterior surface 31 crimped about retaining ring 92 to hold the same in position. Once retaining ring 92 is in position, deflector plate 76 or 76' is attached to ends 82 of deflector attachment arms 80. Thereafter, lever arms 44 are placed in contact with rim 24, with attachment section 48 being supported by inner surface 24'. Preferably, inner surface 24' of rim 24 is sloped in a downward direction, while attachment section 48 of lever arms 44 are curved in a downward direction to thereby engage sloped inner surfaces 24'. The sloped inner surface 24', and downwardly curved attachment sections 48, assure that lever arms 44 are maintained in proper position. Preferably, as depicted in FIG. 18, rim 24 is formed with a pair of slots 24". Slots 24" are each dimensioned to receive a vertical section 50 of lever arm 44, to thereby decrease the diametrical space utilized by sprinkler head 10.

Once lever arms 44 are secured to the exterior of sprinkler body 20, lever bar 100 is placed between lever arms 44 and outlet 30 of sprinkler body 20, while fusible element 46 is attached to ends 56. Thereafter, loading member 66 is placed through center aperture 64 of plates 58, 60 and threaded within center aperture 106 of lever bar 100. Rotation of loading member 66 within center aperture 106 urges lever bar 100 in a downward direction, placing lever arms 44 in tension, which in turn assures vigorous separation once fusible element 46 experiences a preselected temperature. In addition, rotation of loading member 66 within central aperture 106 causes compression pin 98 to move in a direction toward orifice 28 and within cavity 26, with end 112 eventually contacting protuberance 42 formed in undersurface 40 of sealing member 36. Continued rotation of loading member 66 forces sealing member 36 into annular groove 29' of annular seat 29, and thereby assures a fluid tight seal between sealing member 36 and inlet orifice 28.

In an alternative preferred embodiment, as shown in FIG. 16, a lever bar 100' is a generally flat plate having an internal spring force directed towards outlet 30 of sprinkler body 20. Opposing ends 116 and 118 of lever bar 100' each include a notch 120 dimensioned to receive a lever arm 44. Thus, when loading member 66 is rotated in upward direction through central aperture 106, lever bar 100' is drawn in a downward direction, thereby placing lever arms 44 into tension.

In operation, when fusible element 46 experiences a preselected temperature due to the presence of fire, plates 58 and 60 will separate, releasing lever arms 44 and lever bar 100 or 100'. As lever arms 44 and lever bar 100, or 100' fall away from outlet 30 of sprinkler body 20, the compressive force upon compression pin 98 is released. The water pressure acting on sealing member 36, as well as the internal spring force of sealing member 36, causes sealing member 36 to be thrust in a downward direction through cavity 26 and be expelled through outlet 30. As sealing member 36 is urged in a direction towards outlet 30, annular ring 78 will also move towards outlet 30 until abutting contact is made between annular ring 78 and retaining ring 92.

Figure 5:
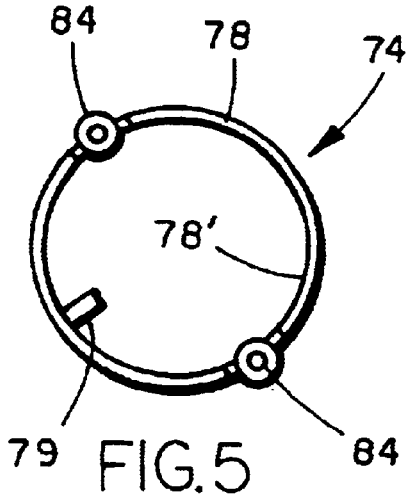
FIG. 5 is a bottom view of the deflector support assembly embodying the present invention.
Figure 8:
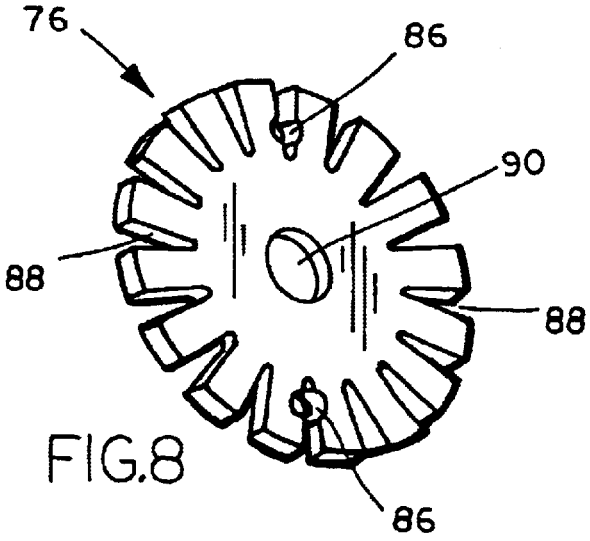
FIG. 8 is a perspective view of a deflector plate according to a preferred embodiment of the invention.

When abutting contact is made between retaining ring 92 and annular ring 78, as shown on FIG. 15, deflector plate 76 or 76' will be positioned a preselected distance beyond outlet 30 and be held at such distance by deflector attachment arms 80 while rim 114 of compression pin 98 will abuttingly contact surface 76" of deflector plate 76 or 76'. Sealing member 36, having an outer dimension less than the inner dimension of annular ring 78, will be expelled from outlet 30 of sprinkler body 20. As shown in FIG. 5, inner surface 78' of annular ring 78 preferably includes an inwardly projecting, horizontal pin 79. As sealing member 36 is being expelled from cavity 26, it will hit horizontal pin 79. Contact between horizontal pin 79 and sealing member 36 causes sealing member 36 to rotate about a horizontal axis and alters its linear trajectory. This in turn prevents sealing member from coming to rest on surface 76" of deflector plate 76, 76' and interfering with the operation of sprinkler head 10. Once sealing member 36 falls away from outlet 30, water will flow through central orifice 26 and be deflected in an optimum pattern by deflector plate 76 or 76' in order to extinguish or suppress a fire.

In a preferred embodiment, the height of sprinkler body 20 is less than or equal to approximately 1.0 inches, while the diameter of cavity 26 is no greater than approximately 0.625 inches. Also, preferably, outlet 30 has a diameter less than or equal to approximately 0.760 inches while inlet orifice 28 has a diameter less than or equal to 0.450 inches, and the diameter defined by groove 29' of annular seat 29 is less than or equal to approximately 0.530 inches. In the preferred embodiment, the diameter defined by arcuate sections 25 of rim 24 is less than or equal to approximately 0.930 inches, with the angle defined by inner surface 24' of annular rim 24 is approximately 25° off the horizontal, while the distance between linear sections 25' is approximately 0.880 inches. Also preferably, the diameter of deflector plate 76, 76' is less than or equal to approximately 0.740 inches.

In the most preferred embodiment, the height of sprinkler head 10 is approximately 0.900 inches, and the diameter of orifice 26 is between approximately 0.618 and 0.613 inches. Also most preferably, the diameter defined by arcuate sections 25 of rim 24 is approximately 0.920 inches, while the distance between linear sections 25' is approximately 0.875 inches, and the diameter defined by groove 29' of annular seat 29 is approximately 0.525 inches. Also, most preferably, the diameter of outlet 30 is between approximately 0.754 and 0.750 inches, while the diameter of deflector 76, 76' is approximately 0.730 inches.

Referring now to FIGS. 19 through 23, according to an alternative preferred embodiment, a sprinkler head 100 includes a sprinkler body 110 having an externally threaded upper region 112 and an externally threaded lower region 114. A rim 116 projects from sprinkler body 110 between upper region 112 and lower region 114. Externally threaded upper region 112 allows removable attachment of sprinkler body 100 to a piping system (not shown) in fluid communication with a source of fire extinguishing fluid. Sprinkler body 110 includes a central orifice 118 having an inlet 120 and an outlet 122. Bottom 124 of sprinkler body 110 is formed with an annular shoulder or counterbore 126.

Figure 19:
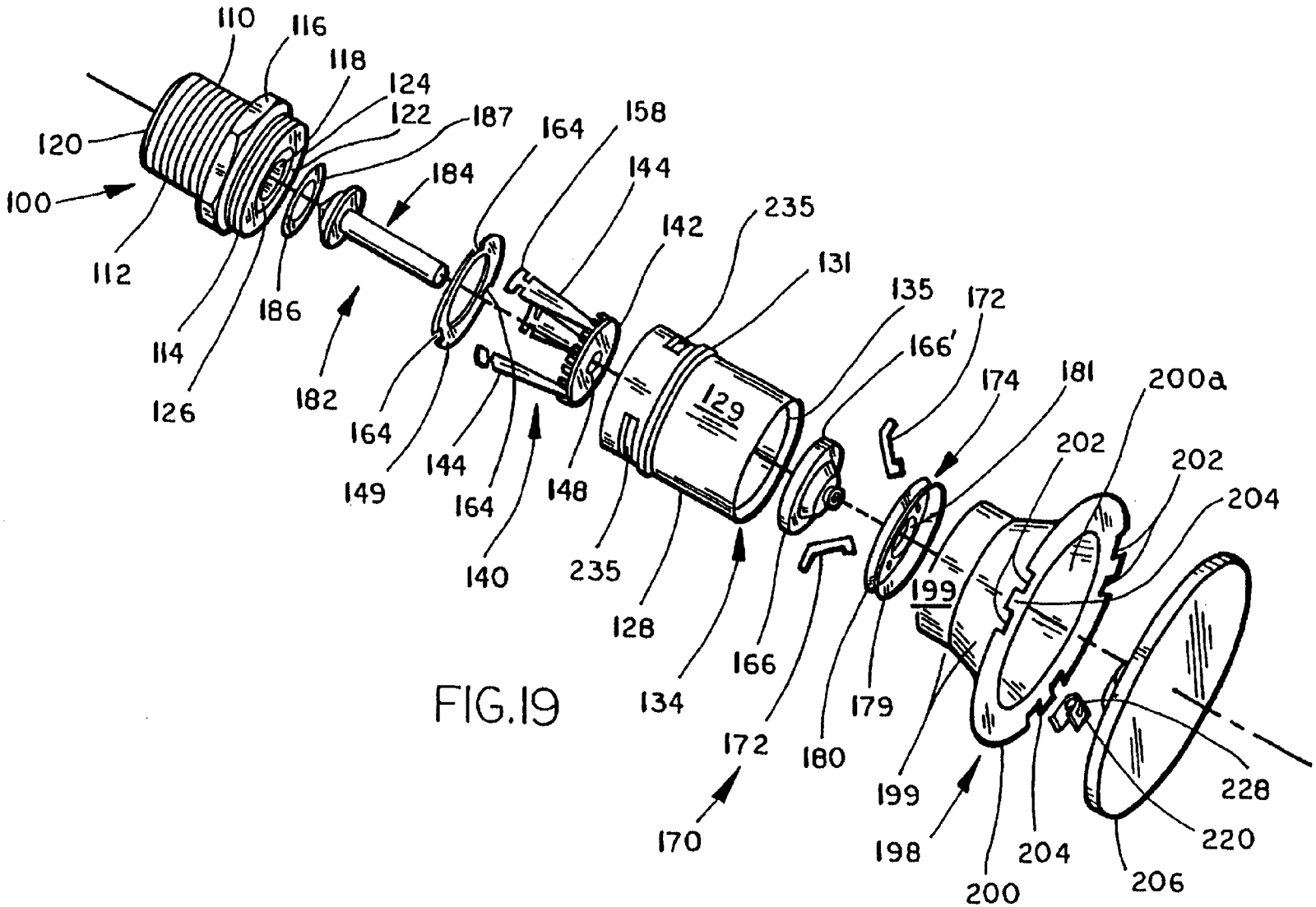
FIG. 19 is an exploded, perspective view of a sprinkler body according to still another alternative preferred embodiment of the present invention.
Figure 20:
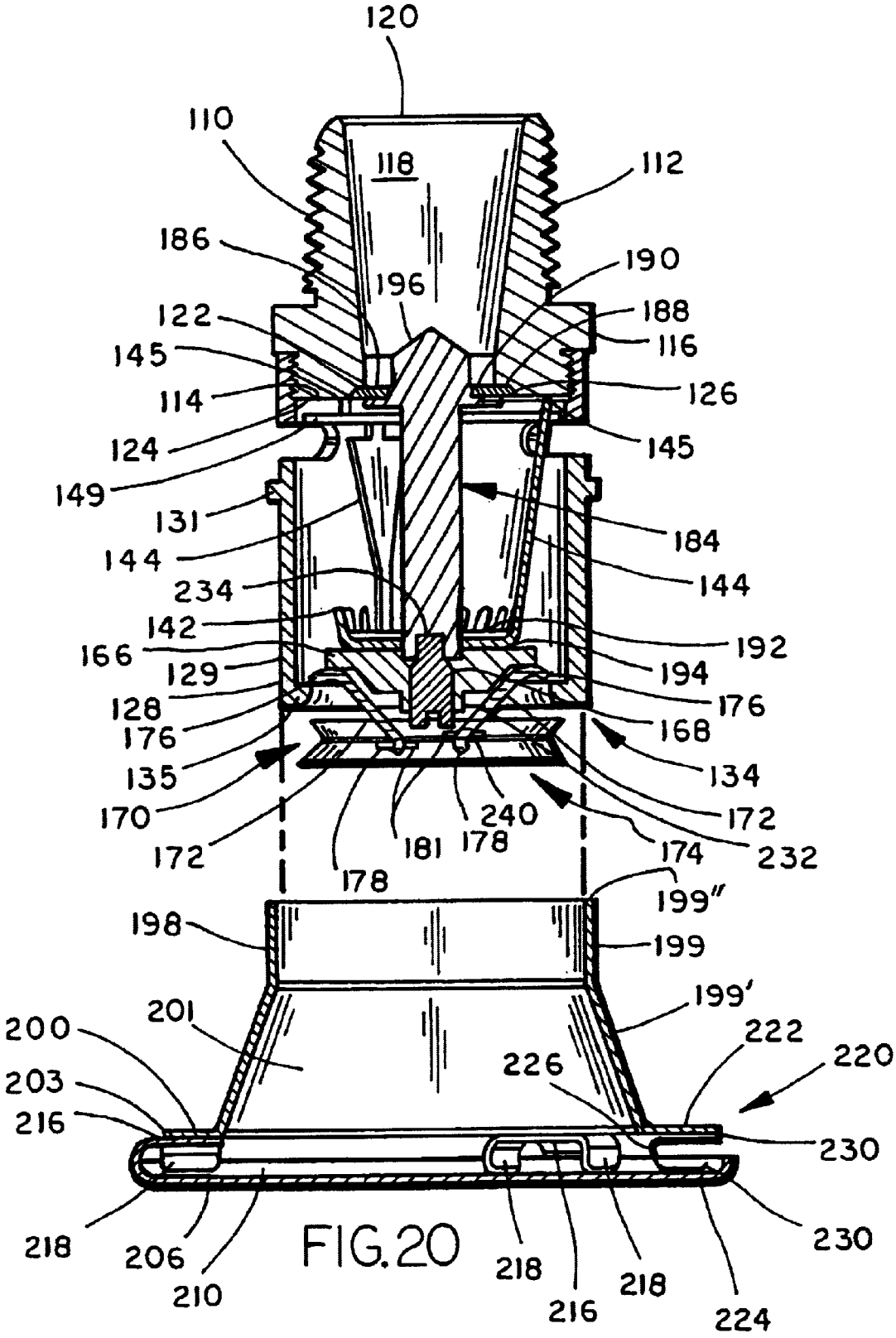
FIG. 20 is a sectional side view of the sprinkler head of FIG. 19, illustrated in the inactive state, with the escutcheon and cover plate exploded from the frame.
Figure 21:
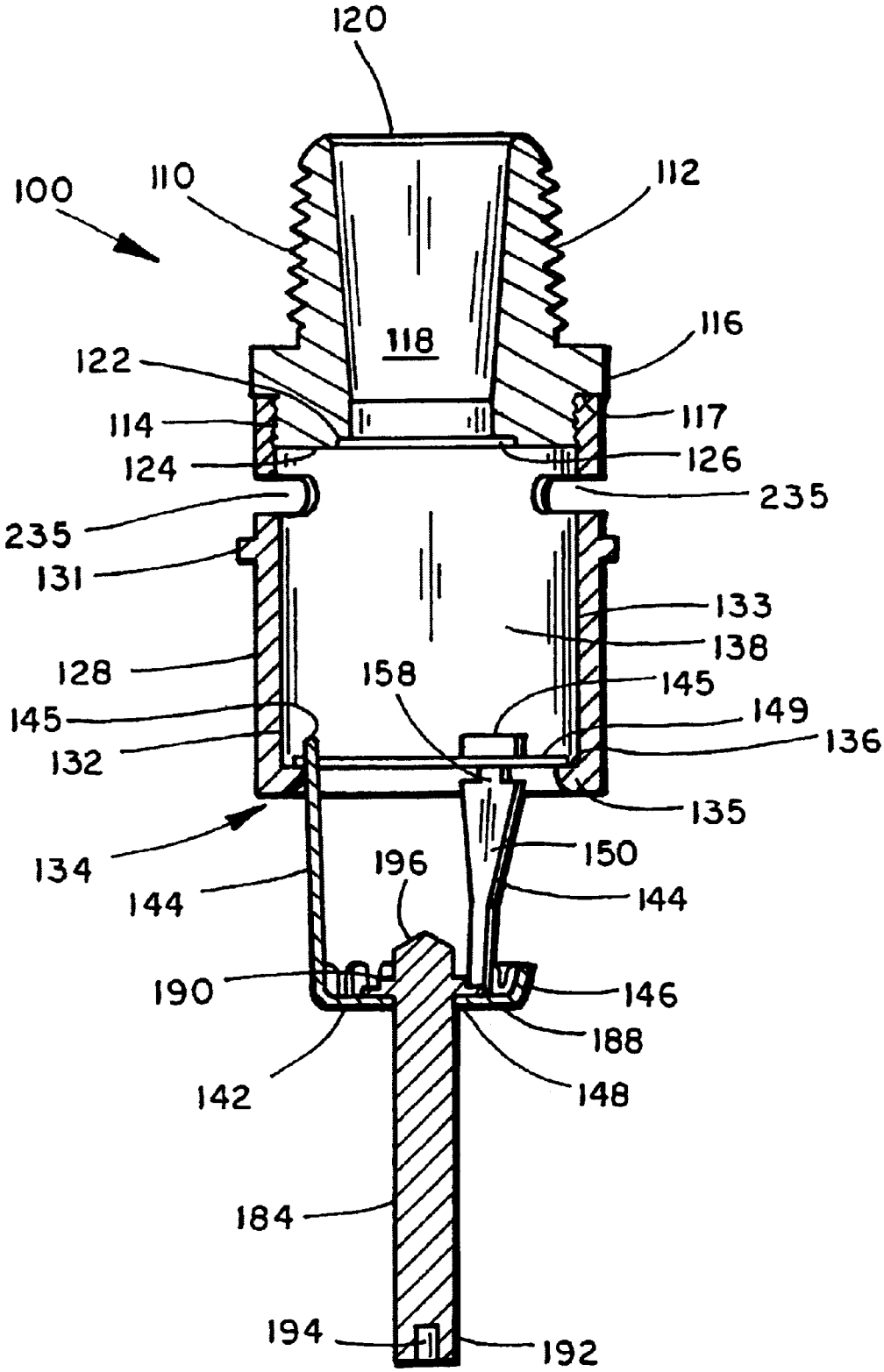
FIG. 21 is a sectional side view of the sprinkler head of FIGS. 19 and 20, with the sprinkler head illustrated in the active state.
Figure 22:
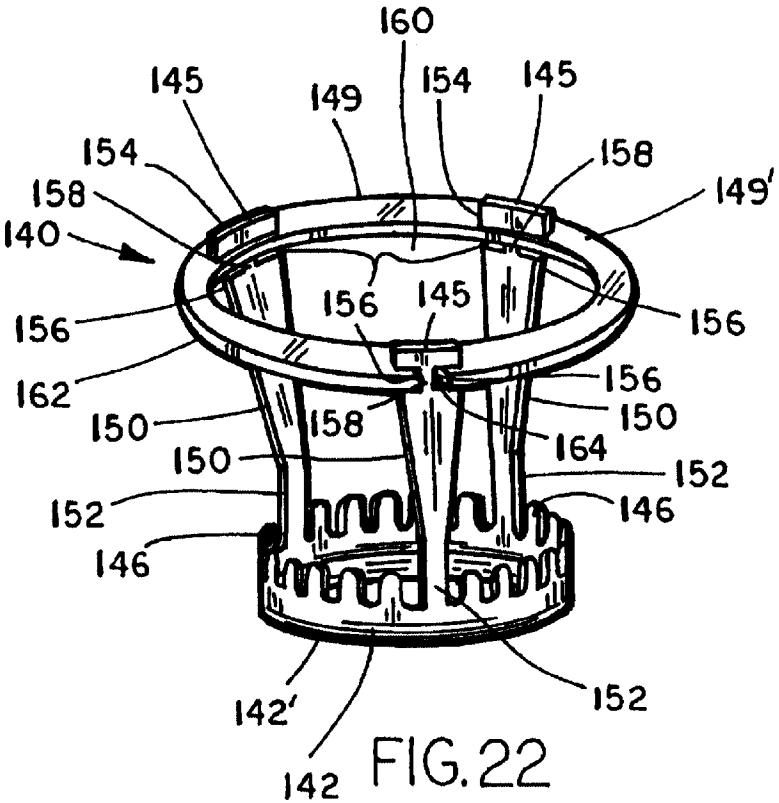
FIG. 22 is a detailed view of the retaining member and deflector of a preferred embodiment of the present invention.
Figure 23:
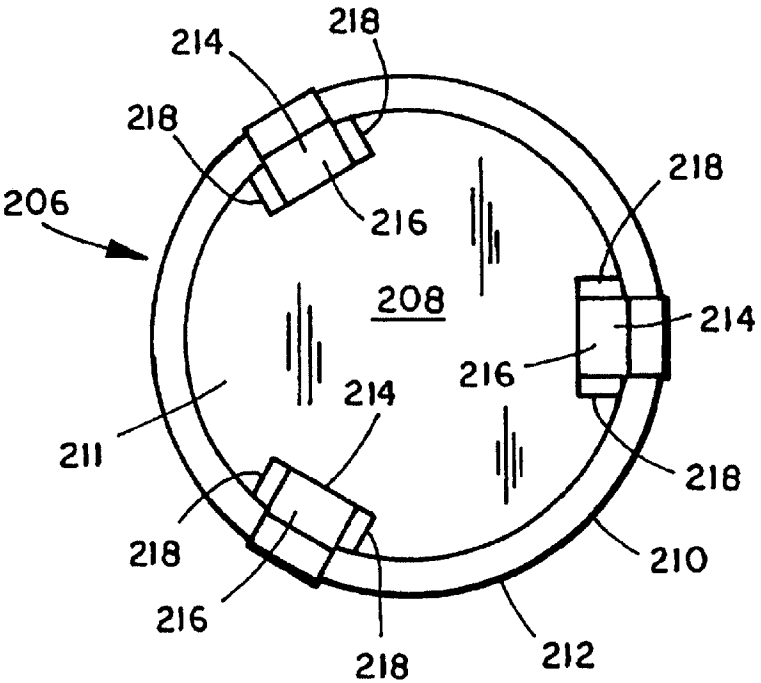
FIG. 23 is a plan view of the cover plate.

A generally cylindrical body extension 128 is threadably attached to lower region 114 of body 110. Extending section or lower region 132 of body extension 128 is positioned beyond bottom 124 of sprinkler body 110 and is formed with an inwardly extending member 134 (FIGS. 19 through 21). Inwardly extending member 134 is preferably an annular rim 135, but may also be, for example, two or more projections extending from inner surface 133, and diametrically opposed.

Positioned within central channel 138 of body extension 128 is a deflector assembly 140. Deflector assembly 140 includes a deflector plate 142 positioned a preselected distance from bottom 124 of sprinkler body 110 by a plurality of support arms 144. Support arms 144 are received by a retaining member 149. Deflector plate 142 includes a plurality of tines 146 positioned about the periphery of deflector plate 142 and spaced a preselected distance apart. Tines 146 project in a direction towards bottom 124 of sprinkler body 110. A central aperture 148 is formed in deflector plate 142. Support arms 144 include a central section 150 having a generally triangular shape and a bottom region 152 which is generally linear. The width of bottom region 152 is preferably no greater than the width of each individual tine 146. Formed in upper section 154 are a pair of notches or cutouts 156 which collectively define a neck 158 therebetween. Preferably, deflector plate 142 and support arms 144 are monolithically formed in a unitary construction by any method commonly utilized in the art. For example purposes only, a planar sheet of suitable material may be stamped or punched to form cut lines and bend lines outlining deflector plate 142 and support arms 144. Thereafter, the sheet of material is cut along the cut lines and subsequently bent along the bend lines by standard bending techniques to form deflector plate 142 and support arms 144. As seen most clearly in FIG. 22, support arms 144 flare slightly outward such that upper sections 154 collectively define a diameter greater than the diameter of deflector plate 142.

Retaining member 149 is preferably an annular ring with a central opening 160 in registry with central orifice 118 of sprinkler body 110. Outer periphery 162 of retaining member 149 includes a plurality of notches 164. The number of notches 164 formed in periphery 162 corresponds to the number of support arms 144 projecting from deflector plate 142. Each notch 164 is dimensioned to geometrically receive neck 158 of a support arm 144. As shown in FIG. 20, when support arms 144 are received by notches 164, ends 145 of support arms 144 are positioned between retaining member 149 and bottom surface 124 of sprinkler body 120, with ends 145 either in abutting contact with bottom surface 124, or in proximity thereto.

Positioned below deflector plate 142 is a lever disk or biasing member 166. Biasing member 166 is formed with a central, internally threaded aperture 168. A trigger assembly 170 is carried by inwardly annular rim 135 of body extension 128 and includes a pair of levers 172 which are operably connected to a thermally sensitive trigger mechanism 174. Ends 176 of levers 172 are supported by inner surface 136 of annular rim 135. Levers 172 depend below body extension 128 with ends 178 received by thermally sensitive trigger mechanism 174. Thermally sensitive trigger mechanism 174 is known in the art and generally comprises one or more plates 179, 180 joined by a heat fusible material. Plates 179, 180 are each formed with a lever receiving aperture 181 which receives and holds ends 178 of levers 172 in a closed position, and a central aperture 181.

To seal outlet 122, a sealing assembly 182 includes an actuator rod 184 and an annular sealing ring 186. As best seen in FIG. 20, actuator rod 184 includes a first annular rim 188 and a second annular rim 190, with first rim 188 having a larger diameter than rim 190. End 192 includes a circular channel 194 terminating a preselected distance within the interior of actuator rod 184. Preferably, sealing ring 186 is a compression spring having an outer diameter greater than the diameter of outlet 122, but less than the diameter of counter bore 126. Sealing ring 186 includes a central opening 187 which is approximately the same diameter as the diameter of end 196 of actuator rod 184.

Slidably positioned over exterior surface 129 of body extension 128 is an escutcheon 198. Escutcheon 198 flares slightly outwardly and includes an annular rim 200 having an outer diameter greater than the diameter of the cavity into which sprinkler head 100 is positioned. Rim 200 of escutcheon 198 includes a plurality of pairs of notches 202. Each pair of notches 202 define a contact surface 204 therebetween. Escutcheon 198 includes a top section 199 and a outwardly tapered section 199'. To attach escutcheon 198 to body extension 128, escutcheon 198 is slidingly placed over exterior 129 until top edge 199" contacts stop member 131 formed on exterior surface 129 of body extension 128. The diameter of top section 199 is slightly greater than the outer diameter of body extension 128 to thereby provide a friction fit between escutcheon 198 and body extension 128.

Figure 24:
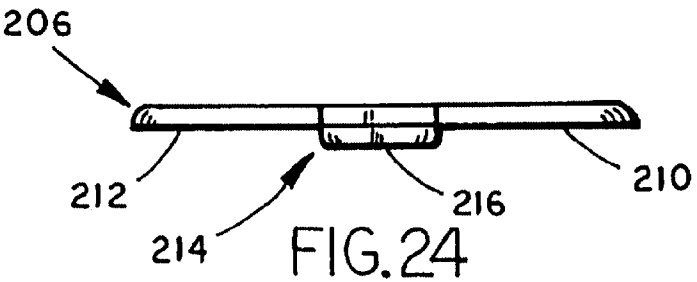
FIG. 24 is a side view of the cover plate of FIG. 23.

A cover plate 206 is attached to annular rim 200 of escutcheon 198 and includes a generally circular planar center section 208 and a peripheral rim 210 projecting in the direction of annular rim 200. Edge 212 of peripheral rim 210 includes a plurality of mounting members 214. Each mounting member 214 includes a generally planar center section 216 connected to a pair of side members 218 projecting towards inner surface 211 of cover plate 206. As shown most clearly in FIG. 23, mounting members 214 extend inwardly towards the center of cover plate 206. Cover plate 206 expresses a diameter greater than or equal to the center opening 200*a* of escutcheon 198 to thereby conceal from view the interior of sprinkler head 100. As shown in FIG. 24, center sections 216 of mounting members 214 are located in a plane spaced from the plane defined by upper edge 212 of peripheral rim 210. Cover plate 206 is attached to annular rim 200 of escutcheon 198 by placing a fusible material between center sections 216 of mounting members 214 and contact surfaces 204 of annular rim 200. As center sections 216 lie in a plane above the plane defined by edge 212, an interstice is formed between annular rim 200 and cover plate 206 to thereby enable the passageway of air towards thermally sensitive trigger mechanism 174.

Referring to FIGS. 19 and 20, an ejector spring 220 is positioned between annular rim 200 of escutcheon 198 and inner surface 211 of cover plate 206. Ejector spring 220 includes a first section 222, and a second section 224 joined by an arcuate bridge section 226. First section 222 has a greater length than second section 224, while bridge member 226 may be formed with a cutout section 228. First section 222 and second section 224 are each formed with a curved lip 230, both of which extend in the same direction. When in position, curved lip 230 of first section 222 is positioned in contact with outer edge 203 of annular rim 200, while second section 224 is positioned in abutting contact with cover 206. When cover 206 is attached to annular rim 200, second section 224 of ejector spring 200 is urged towards first section 222 to thereby place ejector spring 200 in compression. Upon the fusing of the fusible material positioned between annular rim 200 and cover 206, ejector spring 220 is released from compression and forces cover 206 away from annular rim 200.

To assemble sprinkler head 100, levers 172 are placed within body extension 128 so as to be supported by annular rim 135. Ends 178 of levers 172 are then placed within apertures 181 of thermally sensitive trigger mechanism 174. Once thermally sensitive trigger mechanism 174 is attached to levers 172, biasing member 166 is placed over pins 172 and within body extension 128. Thereafter, necks 158 of support arms 144 are placed within notches 164 of retaining member 149. Sealing ring 186 is then placed in abutting contact with rim 190 of actuator rod 184, while actuator rod 184 is placed within body extension 128, with end 192 extending through central aperture 148 of deflector plate 142. Thereafter, body extension 128 is rotatably connected to sprinkler body 110 by rotating body extension 128 into externally threaded lower region 114 of body 110 until abutting contact is made between body extension 128 and rim 117.

As best seen in FIG. 20, a compression member 240, such as, for example, a compression screw, is placed through central aperture 181 of thermally sensitive trigger mechanism 174, and central aperture 168 of biasing member 166. Compression member 240 includes an externally threaded region 232, and a region of reduced diameter 234 dimensioned to be received by channel 194 of actuator rod 184. Compression member 240 is placed through central aperture 181' of thermally sensitive trigger mechanism 174 and rotated within internally threaded aperture 168 of lever biasing member 166 to urge pins 172 in an outward direction, thereby securing pins 172 to thermally sensitive trigger mechanism 174. In addition, the rotation of compression member 240 provides a force upon actuator rod 184 which in turn urges rim 190 of actuator rod 184 in a direction towards inlet 120 of body 110. This force places sealing ring 186 firmly within counter bore 126 and fluidly seals outlet 122 of body 110. Once compression member 240 is threadably secured in channel 194 of actuator rod 184, sprinkler body 118 and body extension 128 are inserted within the cavity and rotatably affixed to a piping system (not shown). Thereafter, cover 206 is attached annular rim 200 of escutcheon 198 as detailed above, and thereafter slidingly placed about exterior 129 of body extension 128.

In the inactive state, ends 145 of support arms 144 will be in abutting contact with bottom surface 124 or in proximity thereto, and above upper surface 149' of retaining member 149. Bottom surface 142' of deflector plate 142 may be in abutting contact with top surface 166' of lever biasing member 166 or spaced slightly thereabove.

When the temperature surrounding sprinkler head 100 increases due to the presence of fire, heated air will travel through the interstice formed between annular rim 200 of escutcheon 198 and cover plate 206 and contact both thermally sensitive trigger mechanism 174 and the fusible material positioned between cover plate 206 and annular rim 200. Exhaustion of heated air from body extension 128 is achieved by at least one exhaust slot 235 formed above stop member 131. Once the fusible material between plates 179, 180 of thermally sensitive trigger mechanism 174 and cover plate 206, and annular rim 200 reaches a preselected temperature, cover plate 206, will separate and be forced in a direction away from body extension 128 by ejector spring 220. Additionally, levers 172 will be released from tension thereby enabling plates 179 and 180 of thermally sensitive trigger mechanism 174 to drop away from body extension 128. When this occurs, sealing ring 186 will urge actuator rod 184 in a direction through body extension 128 and out of sealing engagement with outlet 122 of sprinkler body 120. As the diameter of annular flange 188 is greater than the diameter of central aperture 148 of deflector plate 142, a section of actuator rod 184 will extend beyond deflector plate 142, while end 196 will be captured by deflector plate 142 (FIG. 21). The pressure of fluid traveling through central orifice 118 and the ejection force caused by sealing member 186, will move deflector assembly 140 in a direction away from outlet 122, and towards inwardly extending member 134 of body extension 128. As the diameter of retaining member 149 is greater than the diameter of inwardly extending member 134, inwardly extending member 134 arrests the movement of retaining member 149, enabling deflector plate 142 to extend beyond body extension 128 and be held at a fixed distance from inwardly extending member 134. Fire extinguishing fluid is then expelled from central orifice 118 and travels through body extension 128 and is thereafter deflected in an optimum pattern by deflector plate 142 in an attempt to extinguish or control a fire.

It is to be understood that the foregoing is a description of the preferred embodiments. Those skilled in the art will recognize that variations, modifications and improvements may be made without departing from the spirit and scope of the invention disclosed herein. Consequently, the scope of protection afforded the present invention is to be measured by the claims which follow in the breath of interpretation which the law allows, including the doctrine of equivalents.

The embodiment of the invention in which an exclusive property or privilege is claimed are defined as follows:

1. A sprinkler head for a fire extinguishing system comprising:

a sprinkler body having an orifice, said orifice defining an inlet and an outlet;

a body extension attached to said sprinkler body and having an extending section extending below said outlet of said sprinkler body;

a retaining member positioned below said outlet and within said body extension, said retaining member mounted to be movable relative to said body extension and said sprinkler body, said extending section of said body extension being formed with an inwardly extending member, said inwardly extending member halting movement of said retaining member when said sprinkler is activated;

a deflector movable between an activated position and a storage position within said body extension and having at least one support arm projecting therefrom, said retaining member coupled to said at least one support arm at a fixed distance from said deflector, said support arm movably disposed within said body extension and having generally larger shaped middle section, wherein said deflector and said retaining member are positioned within said body extension when in said storage position;

a sealing assembly configured to sealingly engage said outlet of said sprinkler body, said sealing assembly movable from a closed position wherein said sprinkler head is inactive to an open position wherein said sprinkler head is activated; and a trigger assembly carried by said body extension and operably connected with said sealing assembly and said deflector.

2. The sprinkler head of claim 1, wherein said deflector and said at least one support arm are monolithic.

3. The sprinkler head of claim 1, wherein said inwardly extending member comprises an annular rim.

4. The sprinkler head of claim 1, wherein said body extension has a generally cylindrical shape.

5. The sprinkler head according to claim 1, wherein said retaining member comprises an annular ring.

6. The sprinkler head according to claim 5, wherein said annular ring includes a notch adapted to received said support arm.

7. A sprinkler head for a fire extinguishing system comprising:

a sprinkler body having an orifice, said orifice defining an inlet and an outlet;

a body extension attached to said sprinkler body and having an extending section extending below said outlet of said sprinkler body;

a retaining member positioned below said outlet and within said body extension, said retaining member mounted to be movable relative to said body extension and said sprinkler body;

a deflector movable between an activated position and a storage position within said body extension and having at least two support arms projecting therefrom, said retaining member coupled to said support arms at a fixed distance from said deflector, said support arms movably disposed within said body extension, wherein said deflector and said retaining member are positioned within said body extension when in said storage position;

a sealing assembly configured to sealingly engage said outlet of said sprinkler body, said sealing assembly movable from a closed position wherein said sprinkler head is inactive to an open position wherein said sprinkler head is activated; and a trigger assembly carried by said body extension and operably connected with said sealing assembly and said deflector, wherein said retaining member is captured and halted by said extending section of said body extension when said sprinkler head is activated and said deflector is deployed to its extended position.

8. The sprinkler head according to claim 7, wherein said body extension has a generally cylindrical shape.

9. The sprinkler head according to claim 8, wherein said body extension section is formed with an inwardly extending member.

10. The sprinkler head according to claim 7, wherein said retaining member comprises an annular ring.

11. The sprinkler head according to claim 10, wherein said annular ring includes at least two notches, each of said notches for receiving a portion of a respective support arm.

12. A sprinkler head for a fire extinguishing system comprising:

a sprinkler body having an orifice, said orifice defining an inlet, and an outlet;

a body extension attached to said sprinkler body and having an extending section extending beyond said outlet of said sprinkler body;

a retaining member positioned beyond said outlet and within said body extension, said retaining member mounted to be movable relative to said body extension and said sprinkler body;

a deflector movable between an activated position and a storage position within said body extension and having at least one support arm projecting therefrom, said retaining member coupled to said at least one support arm at a fixed distance from said retaining member, said support arm movably disposed within said body extension, wherein said deflector and said retaining member are positioned within said body extension when in said storage position, and wherein said retaining member comprises an annular ring having an outer periphery, said outer periphery having at least one notch formed therein, wherein said at least one support member has an upper section dimensioned for receipt by said at least one notch;

a sealing assembly configured to sealingly engage said outlet of said sprinkler body, said sealing assembly movable from a closed position wherein said sprinkler head is inactive to an open position wherein said sprinkler head is activated; and a trigger assembly carried by said body extension and operably connected with said sealing assembly and said deflector.

13. The sprinkler head of claim 12, wherein said upper section is formed with a pair of cut-out sections which collectively define a neck, wherein said at least one notch is dimensioned to receive said neck.

14. The sprinkler head of claim 12, wherein said at least one support member is three support members, and wherein said at least one notch is three notches.

15. A sprinkler head for a fire extinguishing system comprising:

a sprinkler body having an orifice, said orifice defining an inlet and an outlet;

a body extension attached to said sprinkler body and having an extending section extending beyond said outlet of said sprinkler body;

a retaining member positioned beyond said outlet and within said body extension, said retaining member mounted to be movable relative to said body extension and said sprinkler body;

a deflector movable between an activated position and a storage position within said body extension and having at least one support arm projecting therefrom, said retaining member coupled to said at least one support arm at a fixed distance from said retaining member, said support arm movably disposed within said body extension, wherein said deflector and said retaining member are positioned within said body extension when in said storage position;

a sealing assembly configured to sealingly engage said outlet of said sprinkler body, said sealing assembly movable from a closed position wherein said sprinkler head is inactive to an open position wherein said sprinkler head is activated, and wherein said sprinkler body has a bottom formed with an annular shoulder and said sealing assembly further comprises an annular spring positioned within said annular shoulder and a rod formed with a section extending through said annular spring, said rod configured to place said annular spring in compression when said sprinkler head is inactive; and a trigger assembly carried by said body extension and operably connected with said sealing assembly and said deflector.

16. The sprinkler head of claim 15, wherein said rod is supported by said deflector when said sprinkler head is in the activated state.

17. A sprinkler head for a fire extinguishing system comprising:

a sprinkler body having an orifice, said orifice defining an inlet and an outlet;

a body extension attached to said sprinkler body and having an extending section extending beyond said outlet of said sprinkler body, wherein said body extension is formed with at least one air exhaust port;

a retaining member positioned beyond said outlet and within said body extension, said retaining member mounted to be movable relative to said body extension and said sprinkler body;

a deflector movable between an activated position and a storage position within said body extension and having at least one support arm projecting therefrom, said retaining member coupled to said at least one support arm at a fixed distance from said retaining member, said support arm movably disposed within said body extension, wherein said deflector and said retaining member are positioned within said body extension when in said storage position;

a sealing assembly configured to sealingly engage said outlet of said sprinkler body, said sealing assembly movable from a closed position wherein said sprinkler head is inactive to an open position wherein said sprinkler head is activated; and a trigger assembly carried by said body extension and operably connected with said sealing assembly and said deflector.

18. A sprinkler head for a fire extinguishing system comprising:

a sprinkler body having an orifice, said orifice having an inlet, an outlet, and a bottom surface;

a body extension attached to said sprinkler body and having an extending section extending beyond said outlet;

a retaining member slidably positioned beyond said outlet and within said body extension;

a deflector positioned below said retaining member and mounted to said retaining member by at least two support members projecting from said deflector toward said retaining member, wherein said deflector and said at least two support members are monolithically formed;

a sealing assembly configured to sealingly engage said outlet of said sprinkler body, said sealing assembly movable from a closed position wherein said sprinkler head is inactive to an open position wherein said sprinkler heed is activated; and a trigger assembly carried by said body extension and operably connected with said sealing assembly.

19. The sprinkler head of claim 18, wherein said body extension is configured to arrest the movement of said retaining member when said sprinkler head is activated.

20. The sprinkler head of claim 18, wherein said extending section is formed with an inwardly extending member, said inwardly extending member arresting the movement of said retaining member when said sprinkler head is activated.

21. The sprinkler head of claim 18, wherein said at least one support member has a generally larger shaped middle section.

22. The sprinkler head of claim 18, wherein said retaining member comprises an annular ring having an outer periphery, said outer periphery having a pair of notches formed therein, wherein said at least two support members each have an upper section formed with a pair of cutout sections which define a neck; wherein each notch of said pair of notches is dimensioned to receive said neck.

23. The sprinkler head of claim 22, wherein said rod is slidably positioned through said deflector.

24. The sprinkler head of claim 18, wherein said bottom surface of said sprinkler body is formed with an annular shoulder and said sealing assembly further comprises an annular spring positioned within said annular shoulder, and a rod having an annular flange, said annular flange placing said annular spring in compression when said sprinkler head is inactive.

25. The sprinkler head of claim 18, wherein each support member of said pair of support members is flared outwardly from said deflector to said retaining member.

26. A sprinkler head for a fire extinguishing system comprising:

a sprinkler body having an orifice, said orifice having an inlet, an outlet, and a bottom;

a body extension attached to said sprinkler body and having an extending section extending below said outlet of said sprinkler body and formed with an inwardly extending annular rim;

an annular retaining member positioned beyond said bottom and within said body extension, said annular retaining member having an outer periphery formed with at least one notch, wherein said outer periphery has a diameter greater than the diameter of said inwardly extending annular rim;

a deflector positioned within said body extension and having at least one support arm projecting therefrom, said at least one support arm having an upper region dimensioned for receipt by said at least one notch formed in said annular retaining member;

a sealing assembly configured to sealingly engage said outlet of said sprinkler body, said sealing assembly movable from a closed position wherein said sprinkler head is inactive to an open position wherein said sprinkler head is activated; and a trigger assembly carried by said body extension and operably connected with said sealing assembly.

27. The sprinkler head of claim 26, wherein said deflector and said at least one support arm are monolithic.

28. The sprinkler head of claim 26, wherein said at least one support member has a generally larger shaped middle section.

29. The sprinkler head of claim 26, wherein said bottom of said sprinkler body is formed with an annular shoulder and said sealing assembly further comprises an annular spring positioned within said annular shoulder, and a rod formed with a section extending through said annular spring when said sprinkler head is inactive, said rod configured to place said annular spring in compression when said sprinkler head is inactive.

30. The sprinkler head of claim 26, wherein said body extension is formed with at least one air exhaust port.

31. The sprinkler head of claim 26, wherein said at least one support member is three support members.

32. A sprinkler head for a fire extinguishing system comprising:

a sprinkler body having an orifice, said orifice having an inlet and an outlet;

a slidable deflector support assembly at least partially positioned within said central orifice, said deflector support assembly including an annular ring and at least one attachment arm depending from said annular ring and attached to said deflector, wherein said annular ring has an outer diameter, and wherein said sprinkler head further comprises a retaining ring positioned within said orifice, said retaining ring having an inner diameter, and wherein said inner diameter of said retaining ring is less than said outer diameter of said annular ring;

a deflector carried by said deflector support assembly and positioned in proximity to said outlet;

a trigger assembly carried by said sprinkler body;

a sealing member positioned within said orifice; and a sealing assembly curried by said sprinkler body, said sealing assembly configured to urge said sealing member into sealing engagement with said inlet of said orifice.

33. The sprinkler head as recited in claim 32, wherein said annular ring and said at least one attachment arm are monolithic.

34. The sprinkler of claim 32, wherein said annular ring has an inner surface and a pin projecting inwardly from said inner surface.

35. The sprinkler head of claim 34, wherein said pin extends in a generally horizontal direction.

36. The sprinkler head of claim 35, wherein said retaining ring has an inner surface and at least one slot formed in said inner surface, said at least one slot dimensioned receive said at least one attachment arm.

* * * * *

UNITED STATES PATENT AND TRADEMARK OFFICE

CERTIFICATE OF CORRECTION

PATENT NO. : 6,962,208 B2
APPLICATION NO. : 09/854997
DATED : November 8, 2005
INVENTOR(S) : Scott Thomas Franson et al.

It is certified that error appears in the above-identified patent and that said Letters Patent is hereby corrected as shown below:

Column 12:
Line 15, "embodiment" should be --embodiments--.
Line 38, Claim 1, Insert --a-- after "having".

Column 13:
Line 28, Claim 9, "body extension" should be --extending--.

Column 15:
Line 28, Claim 18, "heed" should be --head--.
Line 46, Claim 22, ";" should be --,-- after "neck".

Column 16:
Line 53, Claim 32, "curried" should be --carried--.

Signed and Sealed this

Sixteenth Day of January, 2007

JON W. DUDAS
*Director of the United States Patent and Trademark Office*